US006024905A

United States Patent [19]

Doris

[11] Patent Number: 6,024,905

[45] Date of Patent: Feb. 15, 2000

[54] APPARATUS AND METHOD FOR DISCONTINUOUS MANUFACTURE OF SHAPED COMPOSITE ARTICLE

[75] Inventor: Colm Doris, Waterford, Ireland

[73] Assignee: HP-Chemie Pelzer Research & Development LTD, Ireland

[21] Appl. No.: 09/115,722

[22] Filed: Jul. 15, 1998

[30] Foreign Application Priority Data

Jul. 17, 1997 [EP] European Pat. Off. ..... 97112191

[51] Int. Cl.[7] ..... B27N 3/02; B27N 3/16

[52] U.S. Cl. ..... 264/121; 425/80.1; 425/218; 425/324.1; 425/453; 425/406

[58] Field of Search ..... 425/80.1, 218, 425/220, 406, 453, 324.1; 264/121, 122

[56] References Cited

U.S. PATENT DOCUMENTS

| | | | |
|---|---|---|---|
| 2,969,104 | 1/1961 | Schubert et al. | 264/121 |
| 3,880,975 | 4/1975 | Lundmark | 264/121 |
| 4,005,957 | 2/1977 | Savich | 425/80.1 |
| 4,163,036 | 7/1979 | Ransmayr et al. | 264/12 |
| 4,881,695 | 11/1989 | Beisswanger | 242/58.4 |
| 5,447,677 | 9/1995 | Griffoul et al. | 425/80.1 |

FOREIGN PATENT DOCUMENTS

| | | |
|---|---|---|
| 1653189 | 12/1971 | Germany . |
| 2224200 | 11/1973 | Germany . |
| 2845112 | 4/1980 | Germany . |
| 61402 | 11/1994 | Ireland . |
| 61403 | 11/1994 | Ireland . |
| 2021169 | 11/1978 | United Kingdom . |
| 94/11168 | 5/1994 | WIPO . |

*Primary Examiner*—Robert Davis
*Assistant Examiner*—Thukhanh T. Nguyen
*Attorney, Agent, or Firm*—Baker & Botts LLP

[57] ABSTRACT

The present invention describes a device for the discontinuous manufacture of shaped composite articles and an appropriate process. The device comprises means (1) for the mixing of fibrous and/or granulated material with a thermoplastic and/or thermosetting binder, means (2) for conveying the mixture to a mat forming chamber (3), the mat forming chamber (3) being a sealed unit made of a lower half (4) and a movable upper half (5) comprising an outer hood and a rotatable drum (6) with a part template (7) having a perforated pattern of the desired article on the circumferential surface of the drum (6), means (8) to adjust the pressure at the surface of the drum (6) and providing a closed loop air circuit via the perforated pattern, skim rollers (9) for detection of the height of said articles, means (10) for the opening of the mat forming chamber (3) allowing the continuation of rotation and/or sucking during the movement of the drum (6) to a drop position (11), second means (12) for conveying the preformed article from drop position (11) to a molding and/or curing station (13).

14 Claims, 10 Drawing Sheets

APPARATUS AND METHOD FOR DISCONTINUOUS MANUFACTURE OF SHAPED COMPOSITE ARTICLE

APPARATUS AND METHOD FOR DISCONTINUOUS MANUFACTURE OF SHAPED COMPOSITE ARTICLE

Figure 1:
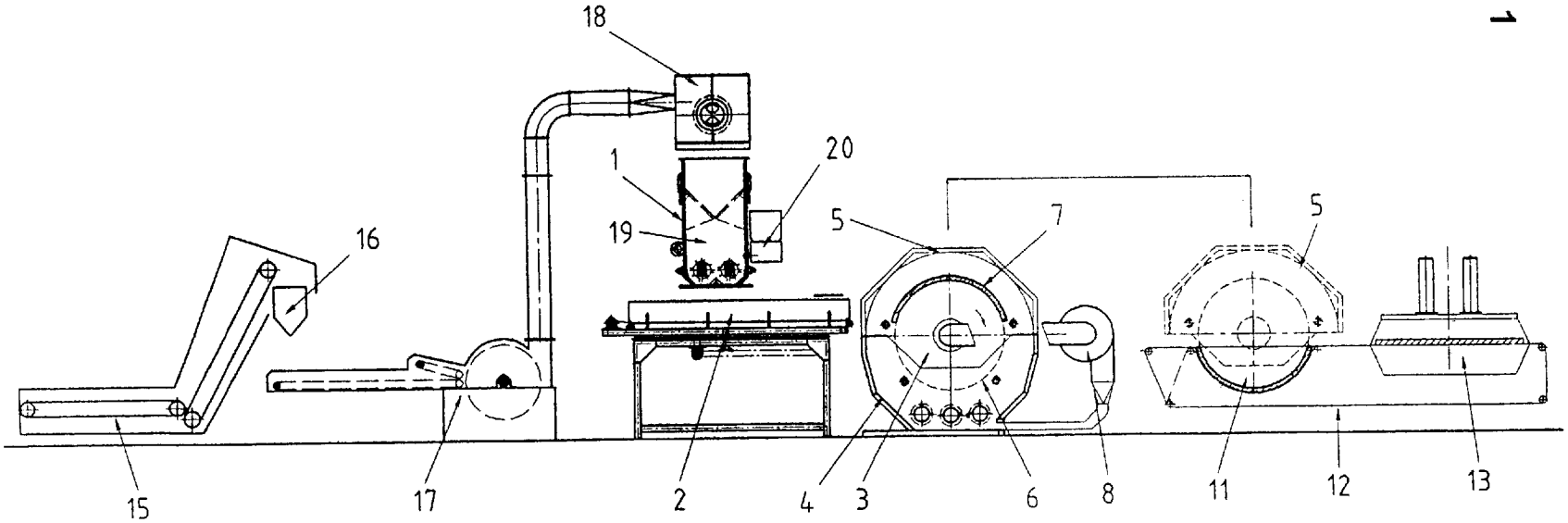

The present invention describes a device for the discontinuous manufacture of shaped composite articles and an appropriate process.

There are currently two main types of processes for the manufacture of molded components, i.e. composite articles in particular from fibers teased out to fiber web-type formation. In one of these processes described in DE 28 45 112 C first of all a continuous mat is produced which is subsequently compacted and cut into rectangular mats. The capital costs of such a traditional felt making is high and causes the production of felts to be centralized in a few locations. This means that plants which process the felt mats further must pay high transport costs for the mats if they are not geographically near the mat processing plant. Most acoustic panels are non-rectangular in shape, yet the traditional felt making plants only offer rectangular shaped mats. Up to 40% waste can be generated in the subsequent molding and die cutting of the rectangular mats.

The second method proposed by the prior art is a discrete process for the manufacture of fibrous web-type molded mats. It also has high capital costs and it is difficult to achieve uniform fiber distribution across the whole part.

Thus, it is the object of the present invention to provide a new device for the discontinuous manufacture of shaped composite articles and an appropriate process involving less costs than known devices and processes.

Said object of the invention is met in a first embodiment by a device for the discontinuous manufacture of shaped composite articles comprising

- means (1) for the mixing of fibrous and/or granulated material with a thermoplastic and/or thermosetting binder,
- means (2) for conveying the mixture to a mat forming chamber (3),
- the mat forming chamber (3) being a sealed unit made of a lower half (4) and a movable upper half (5) comprising an outer hood and a rotatable drum (6) with a part template (7) having a perforated pattern of the desired article on the circumferential surface of the drum (6),
- means (8) to adjust the pressure at the surface of the drum (6) and providing a closed loop air circuit via the perforated pattern,
- skim rollers (9) for control of the height of said articles,
- means (10) for the opening of the mat forming chamber (3) allowing the continuation of rotation and/or sucking during the movement of the drum (6) to a drop position (11),
- second means (12) for conveying the preformed article from drop position (11) to a molding and/or curing station (13).

The advantages of the new device over existing devices can be summarized as following:

- Material savings in that any article shaped can be produced without waste.
- Low capital costs of the machine enables plants which further process the articles and thus are able to produce the articles in-house and will save on transport costs.

The core of the present invention is in particular seen in the enclosed Figs.

FIG. 1 discloses a complete device for the discontinuous manufacture of shaped composite articles. As an example of the composite article a fiber mat is produced.

Figure 2A:
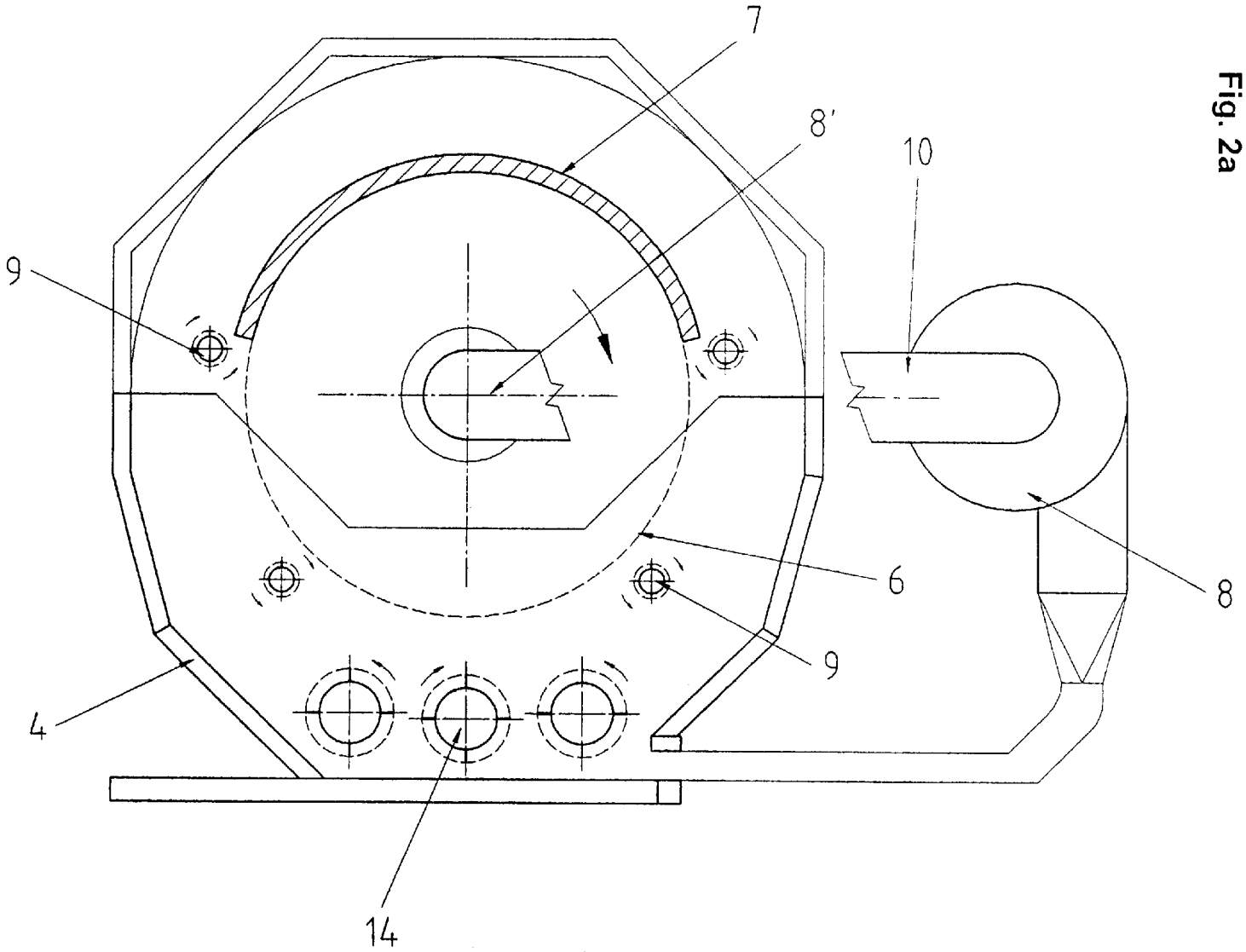
Figure 2B:
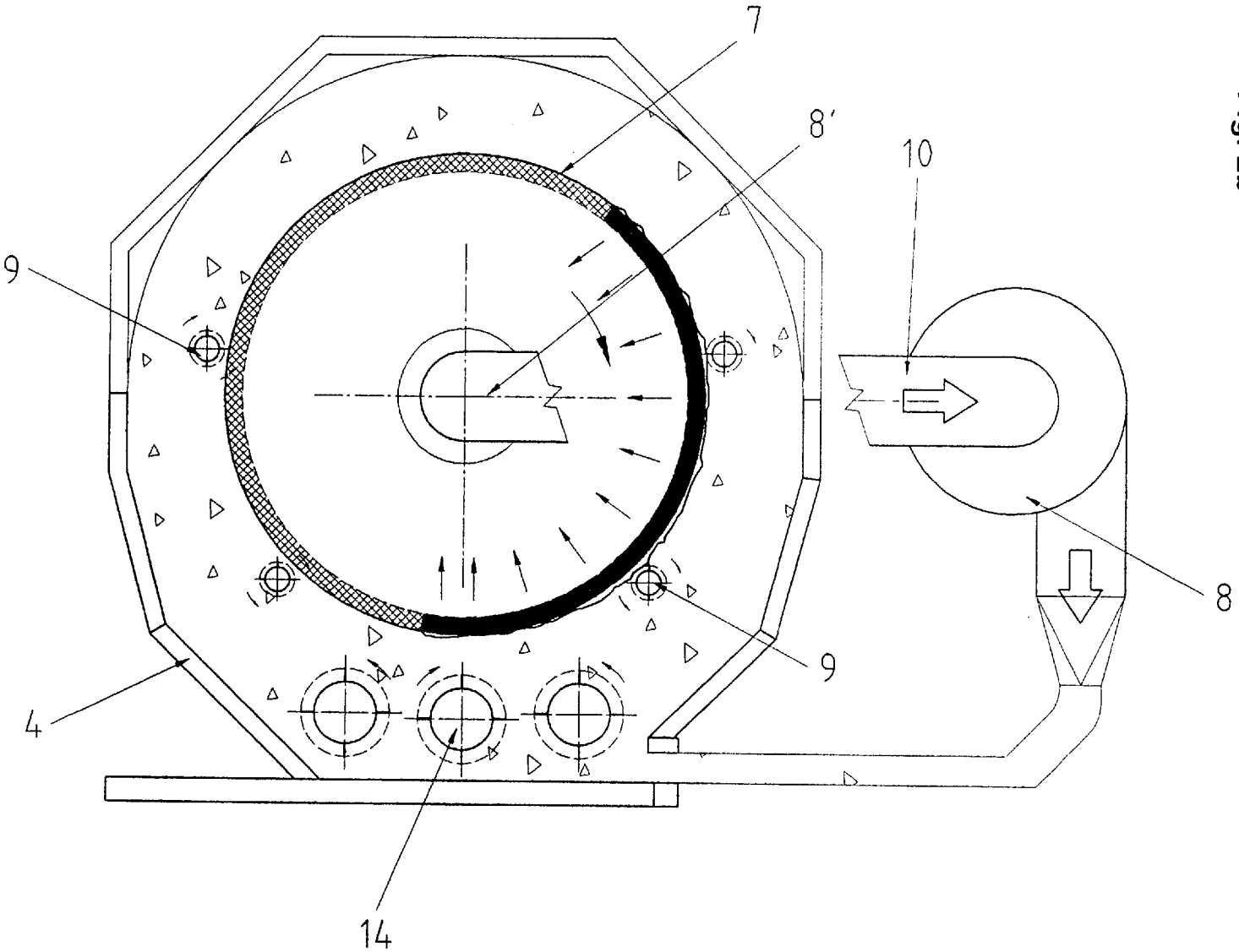

FIGS. 2*a* and 2*b* disclose the novel mat forming chamber in detail.

In FIGS. 3 through 8 the steps of the process for the manufacture of shaped composite articles according to the invention is illustrated.

Figure 9:
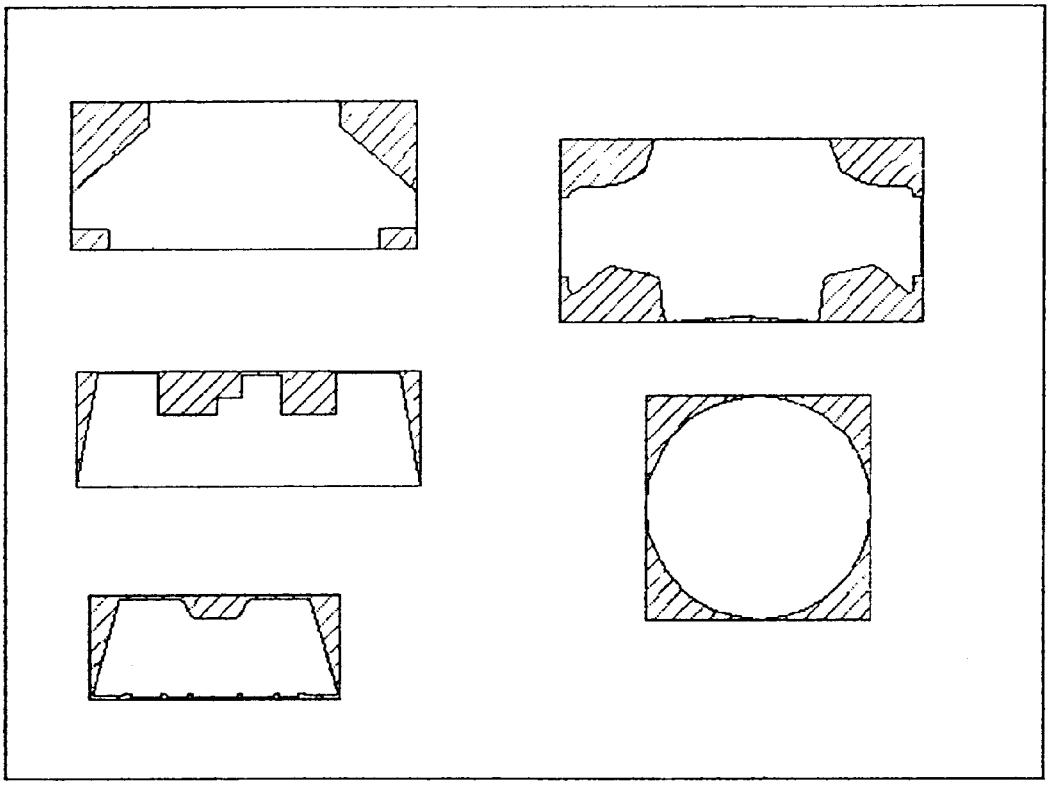

FIG. 9 shows a diagram with the potential material savings of the device for the discontinuous manufacture of shaped composite articles according to the present invention.

A prerequisite of the composite material to be manufactured according to the present invention is the mixing of fibrous and/or granulated material with the thermoplastic and/or thermosetting binder. In FIG. 1 common means 1 for the mixing of fibrous and/or granulated material with a thermoplastic and/or thermosetting binder are shown. The fibers and/or granulated material to be processed are placed in bale form on the infeed conveyor of the bale opener 15. On leaving the bale opener 15 the material enters a scales 16. Once the target weight for the part to be produced is in the scales 16, the material is discharged onto the infeed conveyor belt of a fine opener 17. The fine opener 17 will have one or more tambours to ensure that the material is teased out into single particulates or fibers.

The material is transported to the mixing means 1 by means of material blower via a condenser 18. The material may be discharged into a pre-mixed chamber 19 where they are mixed with the specific amount of binder which is fed from a metering unit 20. After a short period of mixing in the mixing chamber 1 its contents are discharged onto a transport conveyor 2.

FIG. 1 and in more detail FIGS. 2*a* and 2*b* show the mat forming chamber 3 which is a sealed unit made of a lower half 4 and a movable upper half 5 comprising an outer hood and a rotatable drum 6 with the part template having a perforated pattern of the desired article on the circumferential surface of the drum 6. When being in work the pressure at the perforated surface of the drum 6 is adjusted in particular by a closed loop air circuit via the perforated pattern. Thus, and as can be seen in particular from FIG. 2*a* the inside of the drum may be subjected to under pressure which is generated by a fan 10. The drum is connected to the fan by means of a rotary air joint 8' and a flexible pipe.

Thus, FIG. 2*a* shows an unfilled mat forming chamber 3 whereas FIG. 2*b* shows the appropriate device being filled in the perforated parts of the pattern with the desired mixture of fibrous and/or granulated material with thermoplastic and/or thermosetting binder. The multitude of triangles in FIG. 2*b* indicate the flying material in the mat forming chamber 3 when the drum 6 rotates and the perforated pattern of the drum 6 is subjected to under pressure. The closed loop air circuit can be provided in that the output of the fan 10 is fed into the base of the mat forming chamber 3. At the base of the mat forming chamber 3 there are preferably located a number of mixing rollers 14 which keep the materials and binder agitated. As the perforated drum 6 rotates the materials are drawn on to the surface of the drum 6. A part template 7 fitted to the drum perimeter blocks the areas without perforation so that the required part shape is only produced.

As the partially perforated drum 6 rotates the material builds up on the drum surface. The height of the part is controlled by at least one or a number of skim rollers (9)

located around the perimeter of the drum 6. The skim rollers 9 ensure uniform part height and therefore uniform part density of the mat.

Because the air system is a closed loop fibrous and/or granulated material or binding agent that escapes through the drum perforations is transported back into the mat forming chamber 3 by the main fan 10. A circular design of the mat forming chamber 3 prevents the build up of binding agent on the sides of the mat forming chamber 3 as the airborne material tend to clean the surface as they rub against them.

Part densities of the mat depend on the following system parameters which may be adjusted by the artisan according to the required need:

1. main fan pressure
2. skim roller depth
3. part surface area and
4. type of fibrous and/or granulated material being processed.

In the following the process steps will be illustrated on the basis of FIGS. 3 to 8.

Figure 3:
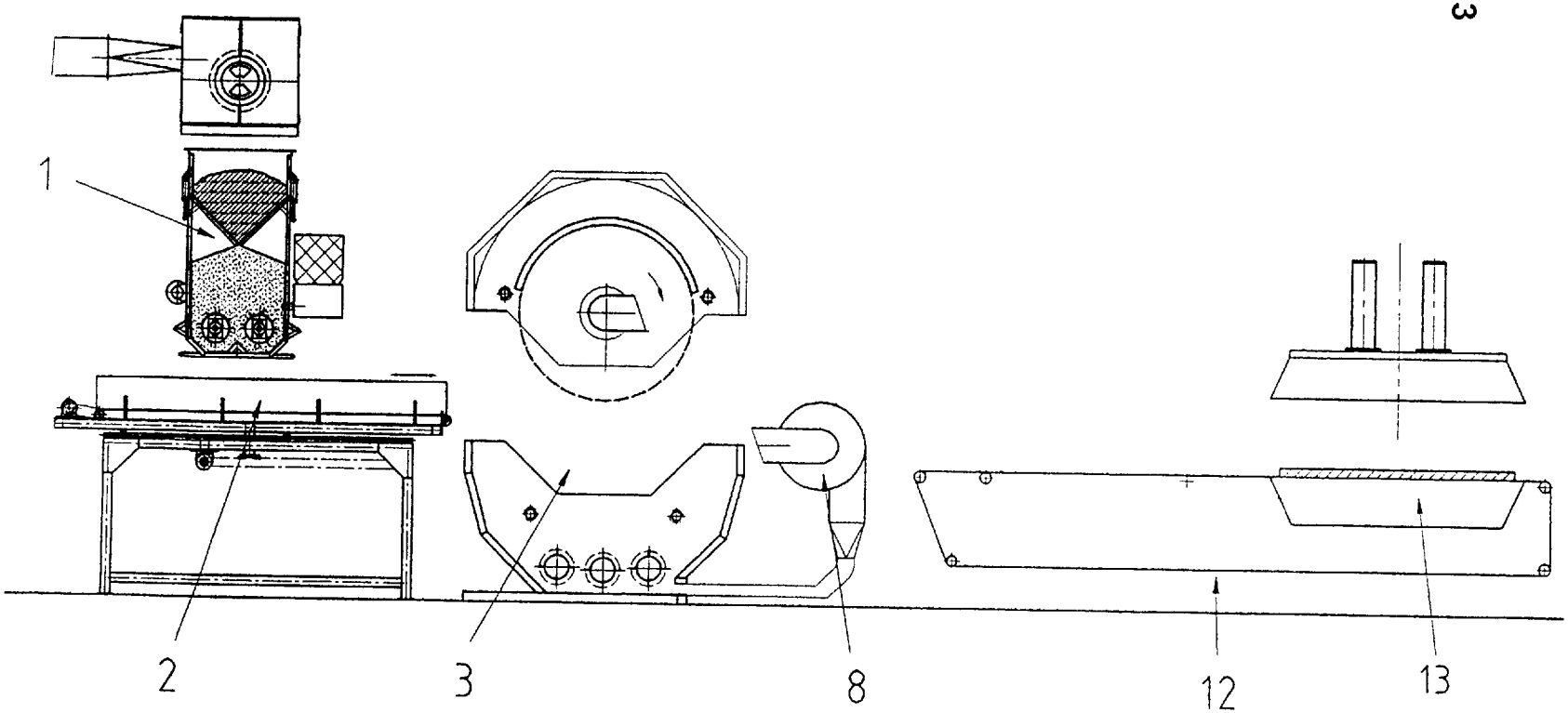

In FIG. 3 the mixing of the fibrous and/or granulated material with the thermoplastic and/or thermosetting binder is illustrated in mixing means 1.

Figure 4:
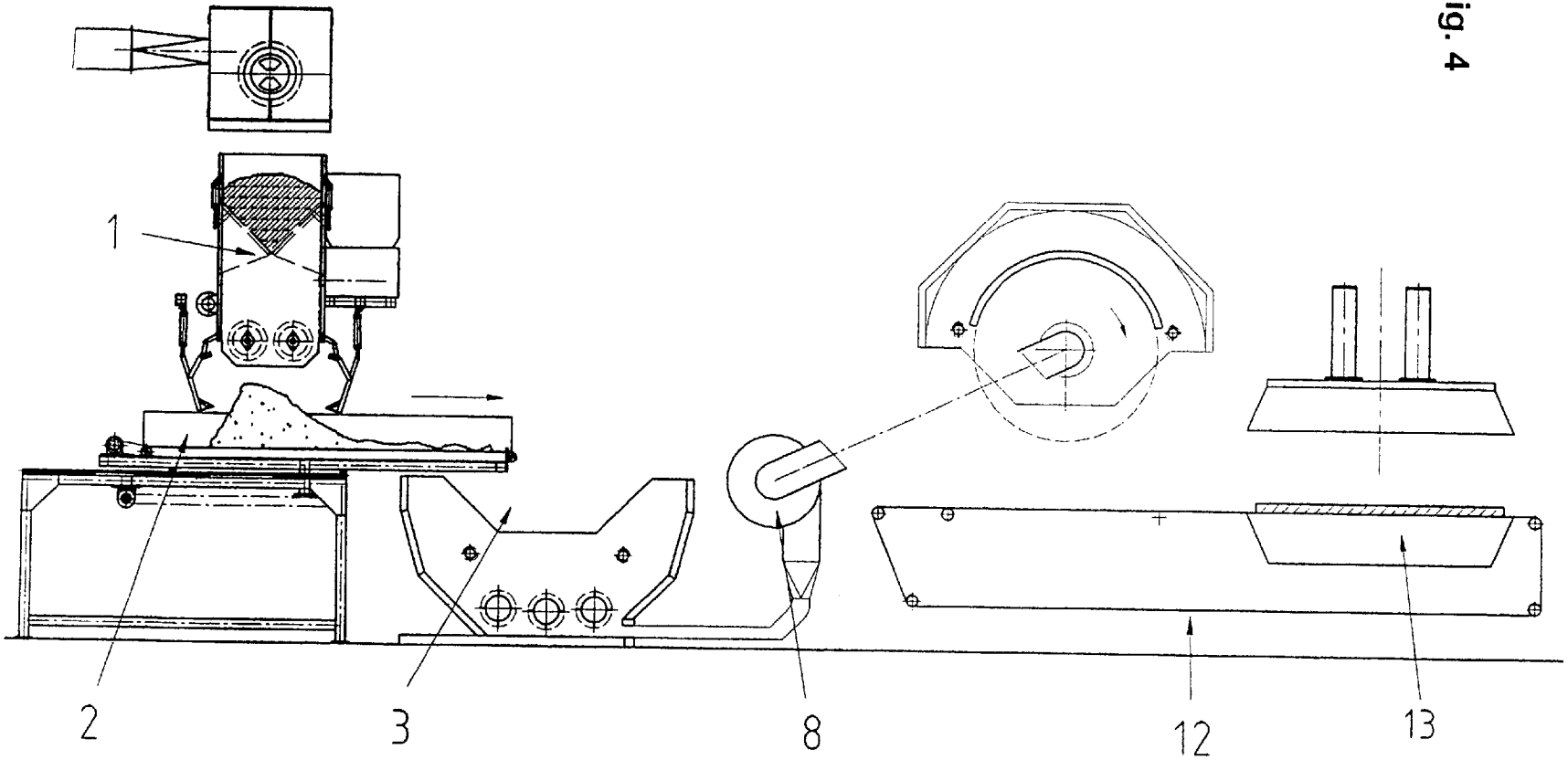
Figure 5:
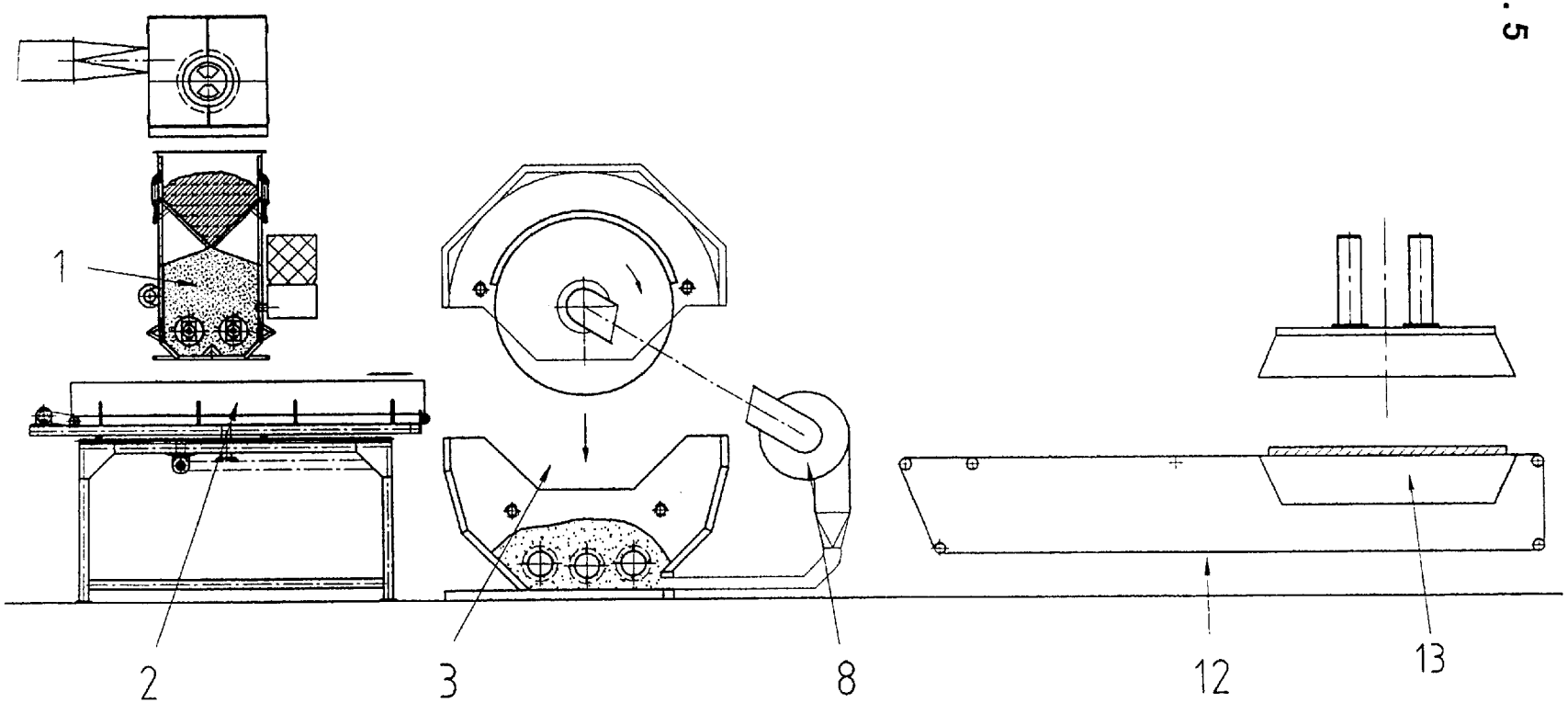
Figure 6:
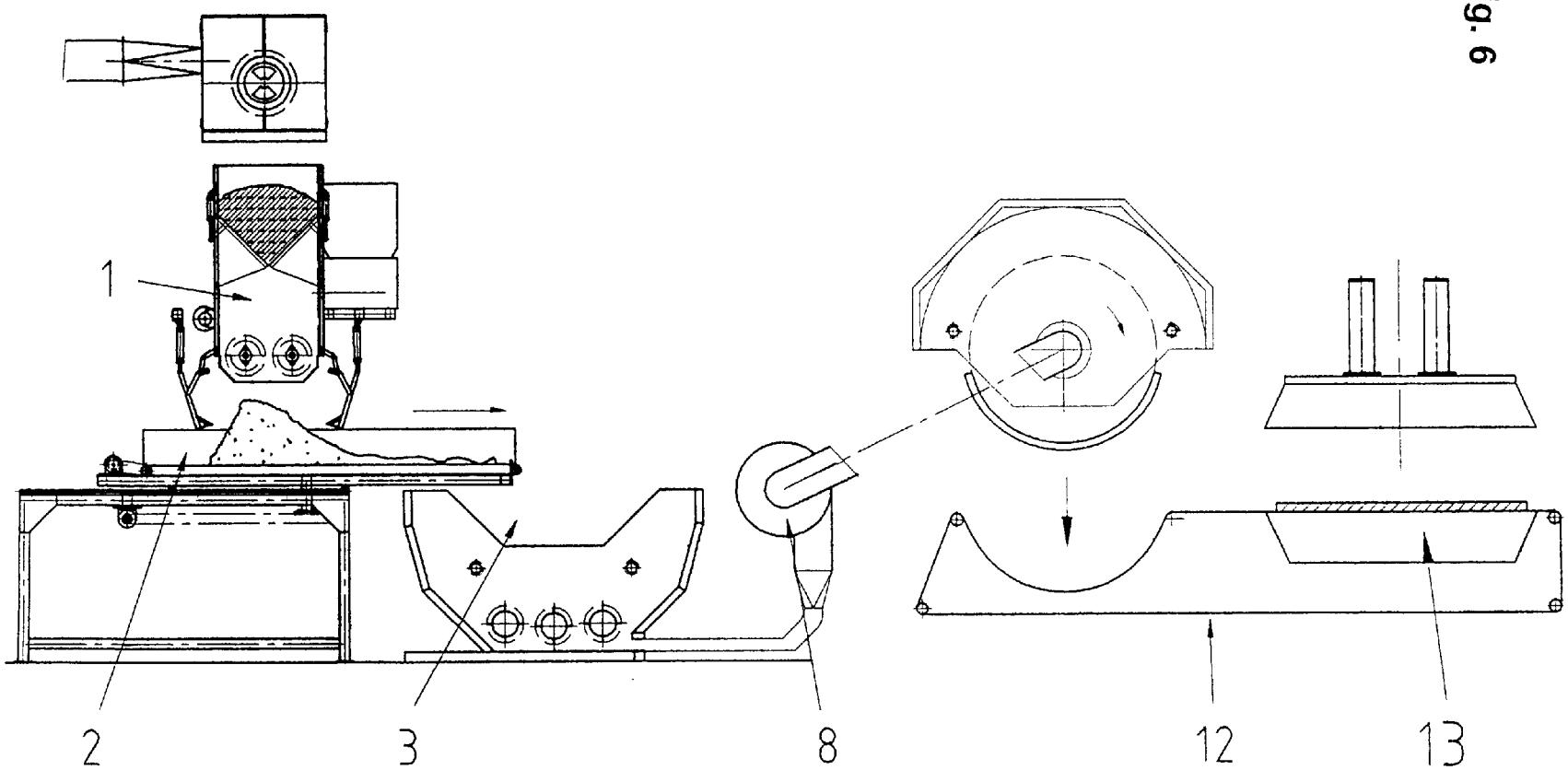

FIG. 4 indicates the conveying of the mixture of fibrous and/or granulated material with the thermoplastic and/or thermosetting binder to the mat forming chamber 3. Said mat forming chamber 3 is in an opened position and thus, the mixture of said material is filled to the base of the mat forming chamber 3 which is still in an open position in FIG. 5. When the complete material is filled in to the mat forming chamber 3 said mat forming chamber 3 will be closed as can be seen in particular in FIG. 2*a*. When the drum 6 is rotated and the perforated surface of the drum 6 is subjected to underpressure, in particular by a closed loop air circuit, the fibrous and/or granulated material as well as the thermoplastic and/or thermosetting binder will be deposited on the perforated pattern of the drum 6

Depending on the above mentioned system parameters an appropriate composite article will be formed on the surface of the drum 6. As soon as the required parameters are fulfilled, the mat forming chamber 3 is opened as can be for example seen in FIG. 6. It is of course necessary to maintain the reduced pressure at the surface of the pattern on the drum 6 in case that the mat positioned on drum 6 will not maintain its location by itself. Thus, in a next step the drum 6 will have to be moved to a drop position 11.

Figure 7:
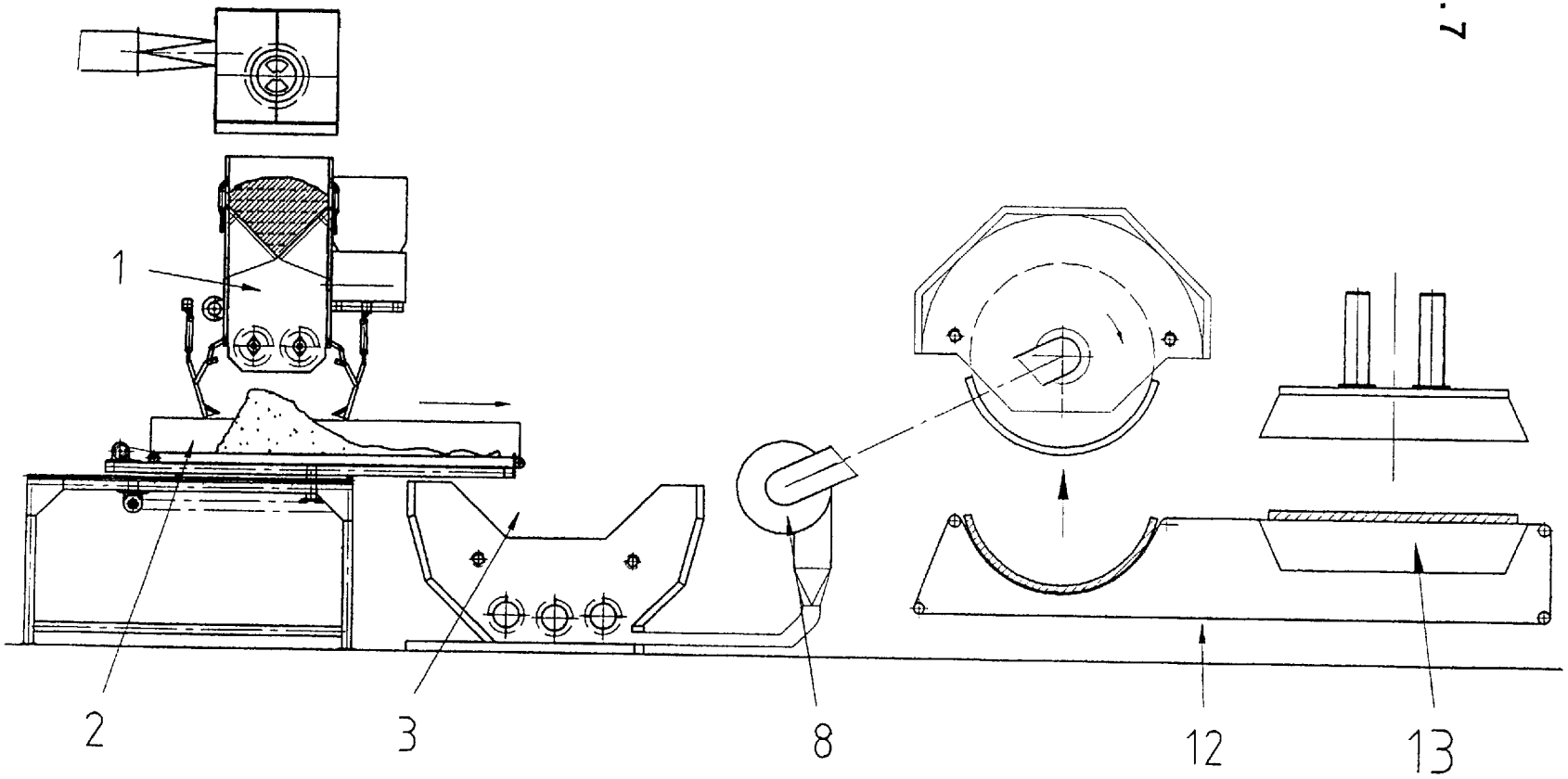
Figure 8:
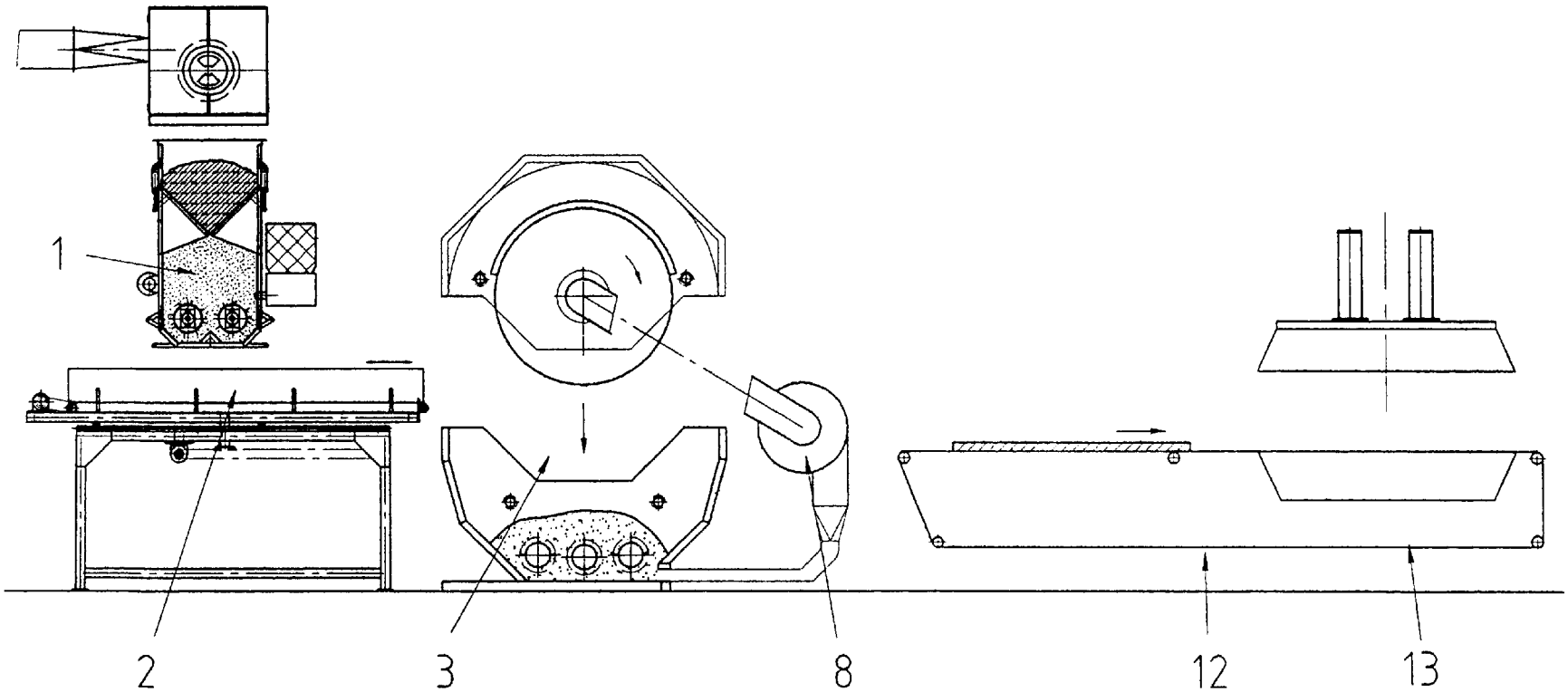

When the drum is moved to the drop position 11 the fan 10 is turned off and the parts are deposited onto the second curved conveyor 12 as can be seen in FIGS. 7 and 8. The parts are then transported with said second conveyor means 12 to the curing station 13. The parts can be cured by using common media like dry steam hot air or contact heating depending on the mix of fibrous and/or granulated material and depending on the behavior of the thermoplastic and/or thermosetting binder.

FIG. 9 in particular shows a diagram with the potential material savings of the device for the discontinuous manufacture of shaped composite articles according to the present invention. In particular the area having scratched lines can be saved in the production of the present invention.

In a preferred embodiment the device of the present invention comprises a mat forming chamber 3 having inside a cylindrical design being parallel aligned with the axis of the drum 6. This is particular has the benefit in that the inside surface of the mat forming chamber 3 can be kept clean since the rotating fibrous and/or granulated materials will clean said surface. Because of the specific geometry of the mat forming chamber 3 the part density is very uniform over the entire composite article surface.

In order to improve the mixing quality in the mat chamber 3 according to the present invention preferably comprises mixing rollers 14 located at the base thereof.

In a further embodiment the drum 6 according to the present invention is connected to a fan 10 by means of rotary air joint and a flexible pipe in order to provide a closed loop air circuit via the perforated pattern.

A further embodiment of the present invention is to be seen in the process for the manufacture of shaped composite articles by mixing fibrous and/or granulated material with the thermoplastic and/or thermosetting binder, conveying the mixture to a mat forming chamber (3) made of a lower half (4) and a movable upper half (5) comprising an outer hood and a rotatable drum (6) with a part template (7) having a perforated pattern of the desired article on the circumferential surface of the drum (6), rotating the drum (6), sucking air in a closed loop circuit via the perforated pattern, densifying said mixture on the circumferential surface of the drum (6) in the perforated pattern and controlling the height of the preformed mat by skim rollers (9), moving the drum (6) to a drop position (11) and releasing the preformed article to be conveyed to a curing and/or molding station (13).

As well as being able to manufacture different part shapes it is possible to manufacture parts with different densities. The device of the present invention is able to process fibrous and/or granulated material, in particular fibrous material, or shredded material like waste, carpets, chip foam, paper or a combination thereof with said binder. In a preferred embodiment the present invention embraces the processing of fibrous material being selected from natural fibers, in particular cotton fibers and wool fibers and/or synthetic fibers, in particular polyester fibers and multi component fibers, in particular bico fibers. The shaped mats are molded into acoustic panels and trim parts for the automotive industry. Thus, the curing and/or molding of said mat preferably is performed by using dry steam, hot air or contact heating.

Accordingly, the present invention in particular allows the preparation of molded parts in the automobile area, in particular acoustic panels in the area of the engine hood, scuttle (on both sides), tunnel, door, roof, legroom, pumps, A- through D-pillars and ventilation ducts and as optionally self-supporting base for interior trims, in particular for instrument coverings, tunnel trims, door trims, seatback trims, A- through D-pillar trims and as spare wheel coverings, and as parts with double function, especially as roof lining, hat racks, filling pieces, luggage trunk mats and wheel box linings.

List of Reference Signs

| | |
|---|---|
| 1 | Mixing means |
| 2 | Conveying means |
| 3 | Mat forming chamber |
| 4 | Lower half |
| 5 | Upper half |
| 6 | Perforated drum |
| 7 | Part template |
| 8 | Pressure adjusting means |
| 8' | Rotary air joint |
| 9 | Skim rollers |
| 10 | Main fan |
| 11 | Drop position |
| 12 | Second conveying means |
| 13 | Curing/molding station |

-continued

| | |
|---|---|
| 14 | Mixing rollers |
| 15 | Bale Opener |
| 16 | Fiber Scales |
| 17 | Fine Opener |
| 18 | Condenser |
| 19 | Pre-mixing chamber |
| 20 | Binder metering unit |

I claim:

1. A device for manufacturing shaped composite articles comprising:

(a) means for mixing a fibrous material, a granulated material, or a combination thereof with a thermoplastic binder, thermosetting binder, or a combination thereof to form a mixture;

(b) means for conveying the mixture to a mat forming chamber, said mat forming chamber being a sealable unit comprising a lower half and a movable upper half, said upper half comprising an outer hood and a rotatable drum having a circumferential surface comprising a perforated pattern of a desired article and an unperforated portion, said unperforated portion being blocked by a template fitted to the drum;

(c) means for controlling pressure at the circumferential surface of the drum, said means providing a closed loop air circuit via the perforated pattern;

(d) at least one skim roller to control height of said desired article;

(e) means for moving the moveable upper half to a drop position, wherein rotation of the drum, control of the pressure at the circumferential surface of the drum, or both, are continued during the movement of the drum to a drop position; and (f) second means for conveying the preformed article from said drop position to a molding station, a curing station, a molding and curing station, or both a molding station and a curing station.

2. The device according to claim 1, wherein the mat forming chamber has a cylindrical design inside, said cylindrical design being aligned in parallel with drum axis.

3. The device according to claim 1, wherein the mat forming chamber comprises a base portion wherein at least one mixing roller is located in the base portion.

4. The device according to claim 1, wherein the drum is connected to a fan by means of a rotary air joint and a flexible pipe.

5. A process for the manufacture of shaped composite articles comprising:

(a) mixing a fibrous material, a granulated material, or a combination thereof with a thermoplastic binder, thermosetting binder, or a combination thereof to form a mixture, (b) conveying the mixture to a mat forming chamber, said mat forming chamber comprising a lower half and a movable upper half, said moveable upper half comprising an outer hood and a rotatable drum having a circumferential surface comprising a perforated pattern of a desired article and an unperforated portion, said unperforated portion being blocked by a template fitted to the drum;

(c) rotating the drum;

(d) controlling pressure at the circumferential surface of the drum to provide a closed loop air circuit via the perforated pattern;

(e) densifying said mixture to form a mat on the circumferential surface of the drum in the perforated pattern;

(f) controlling height of the preformed mat by at least one skim roller;

(g) moving the moveable upper half and drum to a drop position;

(h) releasing the preformed article from the drum; and (i) conveying said released preformed article to a curing station, molding station, curing and molding station, or both a curing station and a molding station.

6. The process according to claim 5, wherein said step (a) comprises mixing fibrous material, chip foam, granulated waste, paper or a combination thereof with said binder.

7. The process according to claim 6, characterized in that the fibrous material is selected from a group consisting of natural fibers, synthetic fibers, and a combination thereof.

8. The process according to claim 7, wherein the natural fibers are selected from the group consisting of cotton fibers and wool fibers and the synthetic fibers are selected from the group consisting of polyester fibers and multicomponent fibers.

9. The process according to claim 8, wherein the multicomponent fibers are selected from bicofibers.

10. The process according to any one of claims 5 to 9, characterized in that said preformed article is cured by a technique selected from the group consisting of dry steam, hot air, and contact heating.

11. The process according to claim 10, characterized in that said preformed article is molded by contact pressure.

12. The process according to any one of claims 6 to 9, wherein said preformed article is produced for use of molded parts in an automobile.

13. The process according to claim 12, wherein said preformed article is produced for use in an automobile at a location selected from the group consisting of acoustic panels in the area of the engine hood, scuttle (on both sides), tunnel, door, roof, legroom, pumps, A-through D-pillars and ventilation ducts, self-supporting base for interior trims, spare wheel coverings, and parts with double functions.

14. The process according to claim 13, wherein said preformed article is produced for use in an automobile at a location selected from the group consisting of instrument coverings, tunnel trims, door trims, seatback trims, A-through D-pillar trims, roof lining, hat racks, filling pieces, luggage trunk mats, and wheel box linings.

* * * * *